US011510509B2

(12) United States Patent
Lomax et al.

(10) Patent No.: US 11,510,509 B2
(45) Date of Patent: Nov. 29, 2022

(54) MOUNTING A FRAME ONTO A PREVIOUSLY INSTALLED MIRROR

(71) Applicants: Mark Donald Lomax, Hilliard, OH (US); Todd Allen Hite, Gahanna, OH (US); Jeffrey Jay Phipps, Plain City, OH (US)

(72) Inventors: Mark Donald Lomax, Hilliard, OH (US); Todd Allen Hite, Gahanna, OH (US); Jeffrey Jay Phipps, Plain City, OH (US)

( * ) Notice: Subject to any disclaimer, the term of this patent is extended or adjusted under 35 U.S.C. 154(b) by 273 days.

(21) Appl. No.: 16/745,080

(22) Filed: Jan. 16, 2020

(65) Prior Publication Data

US 2020/0146473 A1 May 14, 2020

Related U.S. Application Data

(63) Continuation of application No. 15/465,241, filed on Mar. 21, 2017, now Pat. No. 10,575,662.

(60) Provisional application No. 62/312,566, filed on Mar. 24, 2016, provisional application No. 62/311,236, filed on Mar. 21, 2016.

(51) Int. Cl.
*A47G 1/16* (2006.01)
*A47G 1/02* (2006.01)

(52) U.S. Cl.
CPC ..... *A47G 1/16* (2013.01); *A47G 1/02* (2013.01)

(58) Field of Classification Search
CPC ... A47G 1/00; A47G 1/16; A47G 1/02; A47G 1/1686; A47G 1/215; A47G 1/0627; A47G 2001/0677; A47G 1/0616; B25H 3/04; A47F 5/0838; Y10T 24/44983; Y10T 24/44769; E04F 21/185; E04F 21/1855
USPC .... 248/466, 304, 215, 489, 312.1, 339, 301, 248/300, 475.1, 488, 490; 211/70.1, 70.6, 211/94.01, 94.02, 88.01; 40/606.08; 24/546; 224/546, 556, 560, 564–566; 52/547
See application file for complete search history.

(56) References Cited

U.S. PATENT DOCUMENTS 1,124,093 A * 1/1915 Woodruff ..... E04G 23/0203 52/514
1,520,739 A 6/1921 Zetlitz
1,919,271 A 9/1930 Cady
2,511,083 A 8/1946 Small
D185,897 S 8/1959 Stark
3,536,287 A * 10/1970 Hyman ..... A47G 25/0614 248/909
3,809,349 A 5/1974 Baedke
3,895,605 A 7/1975 Goldman
D236,950 S 9/1975 Goldman
3,986,649 A 10/1976 Heimstra
4,314,429 A 2/1982 Casteel et al.
D266,328 S 9/1982 Fleshman
(Continued)

*Primary Examiner* — Ingrid M Weinhold
(74) *Attorney, Agent, or Firm* — Standley Law Group LLP; Adam J. Smith; Stephen L. Grant

(57) ABSTRACT

Fasteners and methods for mounting a frame onto a previously installed mirror without requiring removal of the previously installed mirror are provided. Each fastener includes a support panel. A first bracket portion extends from a first face of the support panel and is configured to receive a portion of an outer edge of the previously installed mirror. A second bracket portion extends from a second face of the support panel and is configured to receive the frame.

13 Claims, 6 Drawing Sheets

(56) References Cited

U.S. PATENT DOCUMENTS

| | | | | |
|---|---|---|---|---|
| 4,455,806 | A | 6/1984 | Rice | |
| 4,458,873 | A | 7/1984 | Sutherland | |
| 4,918,893 | A | 4/1990 | Vandenbroucke et al. | |
| 5,016,404 | A | 5/1991 | Briggs | |
| 5,020,755 | A | 6/1991 | Frankel | |
| 5,037,051 | A | 8/1991 | Moriello | |
| 5,340,071 | A | 8/1994 | Fox, II | |
| 5,388,738 | A | 2/1995 | Russell | |
| 5,664,392 | A | 9/1997 | Mucha | |
| 5,876,009 | A | 3/1999 | Simoncioni, Jr. | |
| 5,947,433 | A | 9/1999 | Klein | |
| 6,032,842 | A | 3/2000 | Brickner | |
| 6,079,679 | A | 6/2000 | Mitchell | |
| 6,237,802 | B1 | 5/2001 | Douglas | |
| 6,453,523 | B1 | 9/2002 | Teidemann | |
| 6,484,365 | B1 | 11/2002 | Thompson | |
| 6,612,060 | B2 | 9/2003 | Pearce | |
| 6,883,671 | B2 | 4/2005 | Rushing | |
| 7,093,403 | B2 | 8/2006 | Huntting et al. | |
| 7,185,443 | B2 * | 3/2007 | Penhale | E04F 13/0864 33/649 |
| 7,441,382 | B2 | 10/2008 | Beck et al. | |
| 7,533,508 | B1 | 5/2009 | diGirolamo et al. | |
| 7,770,315 | B2 * | 8/2010 | Bauer | A47G 1/215 40/762 |
| 7,802,709 | B1 | 9/2010 | Lewis et al. | |
| 8,225,581 | B2 | 7/2012 | Strickland et al. | |
| 8,387,321 | B2 | 3/2013 | diGirolamo et al. | |
| 8,683,774 | B2 | 4/2014 | Strickland et al. | |
| D704,834 | S | 5/2014 | Bacon et al. | |
| 8,745,959 | B2 | 6/2014 | Strickland et al. | |
| 9,157,572 | B1 | 10/2015 | Merideth | |
| 9,386,867 | B2 * | 7/2016 | Kressin | A47G 1/1653 |
| D781,689 | S | 3/2017 | Darby | |
| D781,690 | S | 3/2017 | Darby | |
| D809,905 | S | 2/2018 | Gunderson et al. | |
| 9,931,988 | B2 | 4/2018 | Culleton et al. | |
| 10,039,394 | B2 * | 8/2018 | Pyle | A47G 1/10 |
| 2002/0023366 | A1 * | 2/2002 | Bueno | E04D 1/34 33/647 |
| 2002/0121066 | A1 | 9/2002 | Callahan et al. | |
| 2002/0170216 | A1 | 11/2002 | Pearce | |
| 2002/0176741 | A1 * | 11/2002 | Anderson | A47G 1/0627 403/403 |
| 2004/0200940 | A1 | 10/2004 | Pacheco | |
| 2006/0272258 | A1 * | 12/2006 | Pollock | E04F 21/1855 52/543 |
| 2008/0006002 | A1 | 1/2008 | Strickland et al. | |
| 2008/0209834 | A1 * | 9/2008 | Ouellette | E04F 21/1855 52/518 |
| 2009/0249743 | A1 | 10/2009 | Bodnar | |
| 2010/0126103 | A1 | 5/2010 | diGirolamo et al. | |
| 2012/0127379 | A1 * | 5/2012 | Wengreen | H05K 5/0204 248/316.1 |
| 2012/0279162 | A1 | 11/2012 | Strickland et al. | |
| 2014/0196400 | A1 | 7/2014 | Bell | |

* cited by examiner

MOUNTING A FRAME ONTO A PREVIOUSLY INSTALLED MIRROR

CROSS-REFERENCE TO RELATED APPLICATIONS

This application is a continuation of U.S. Non-Provisional patent application Ser. No. 15/465,241 filed Mar. 21, 2017, which claims the benefit of U.S. Provisional Patent application Ser. No. 62/311,236 filed on Mar. 21, 2016 and U.S. Provisional Patent application Ser. No. 62/312,566 filed on Mar. 24, 2016, the disclosures of each of the foregoing are hereby incorporated by reference as if fully restated herein.

FIELD OF THE INVENTION

The present invention relates generally to fasteners for mirror frames. More particularly, the present invention relates to fasteners for mirror frames which allow a mirror frame to be mounted onto a pre-mounted mirror without the use of adhesives.

BACKGROUND OF THE INVENTION

Homes will sometimes come with previously installed mirrors, and the homeowner will usually want to make the mirror more aesthetically appealing. The homeowner usually adds a personalized touch to the mirror by mounting a frame onto the previously installed mirror. Traditional methods of mounting the frame onto the mirror rely on permanent fasteners such as nails, adhesives, or screws. Because of this reliance on permanent fasteners, traditional mirror frames are difficult to adjust or replace. Additionally, traditional mirror frame fasteners frequently require the previously installed mirror to be removed before the frame can be mounted onto the mirror.

An objective of the present invention is to address this issue by providing fasteners for mirror frames which do not require the mirror to be removed. Additionally, the present invention makes use of fasteners that are not permanent. Thus, allowing the user to switch frames as desired. The present invention makes use of multiple brackets that can be easily removed from or affixed onto the previously installed mirror.

The present invention is intended to be perimetrically distributed around the frame and the previously installed mirror. This positioning enables the present invention to be used to mount frames of varying shape and size by distributing the present invention around the perimeter of the frame, the user is able to distribute the weight of the frame around the surface of the previously installed mirror.

DETAIL DESCRIPTIONS OF THE INVENTION

Figure 1:
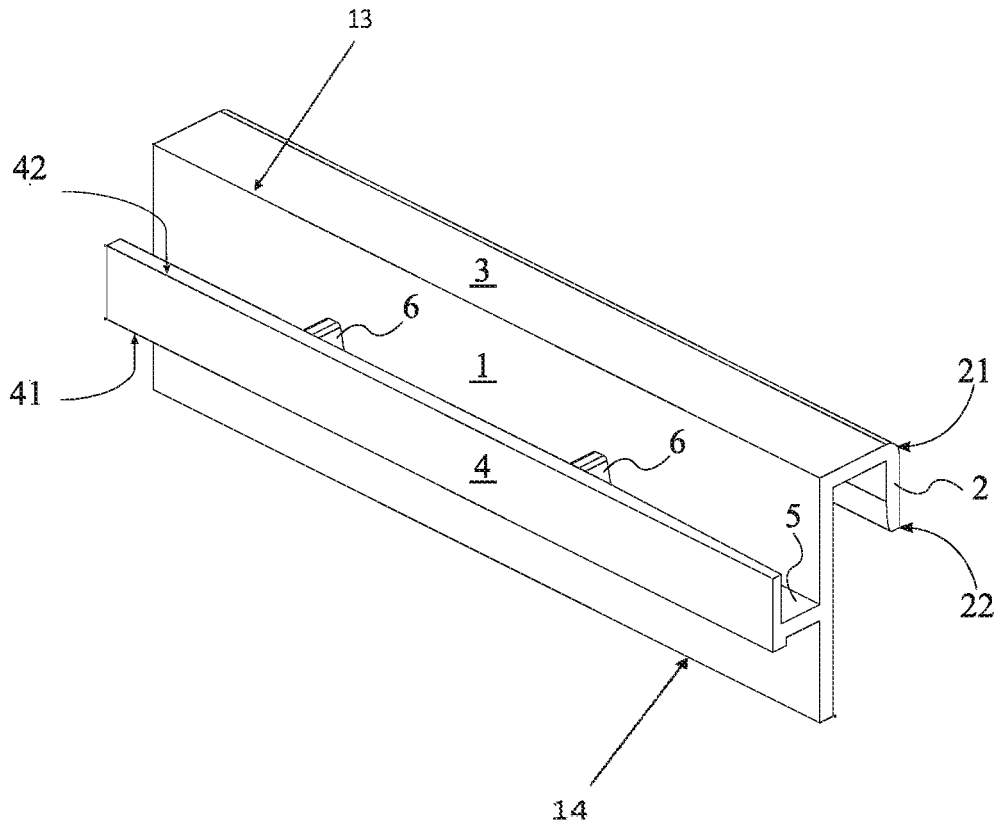
FIG. 1 is a perspective view of the present invention.
Figure 2:
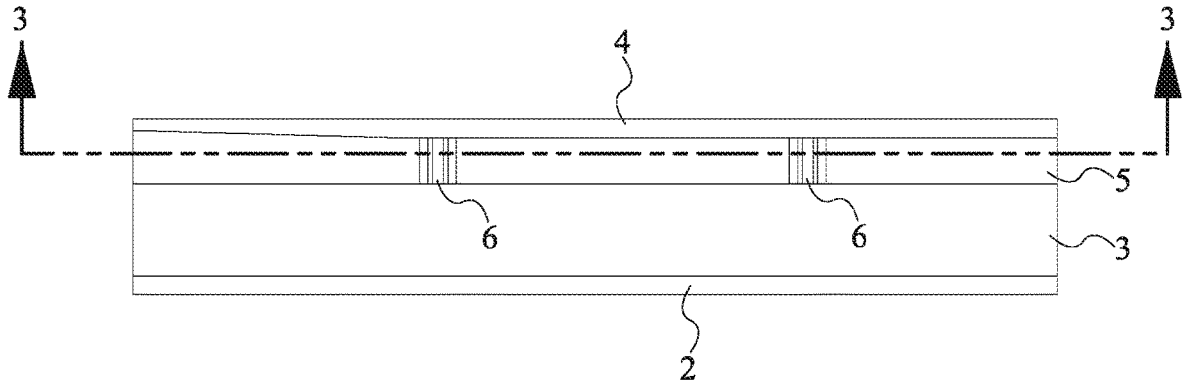
FIG. 2 is a top view of the present invention.
Figure 3:
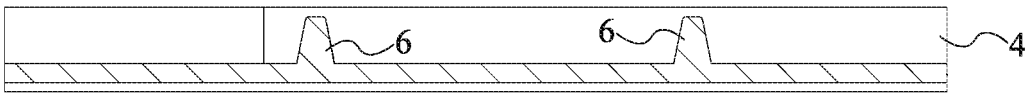
FIG. 3 is a cross sectional view of the present invention taken along line 3-3 in FIG. 2.
Figure 4:
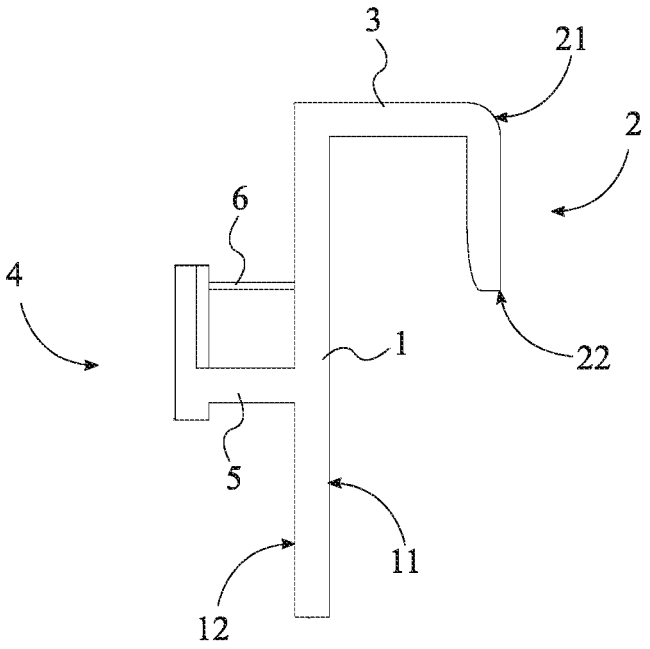
FIG. 4 is a left-side view of the present invention.
Figure 5:
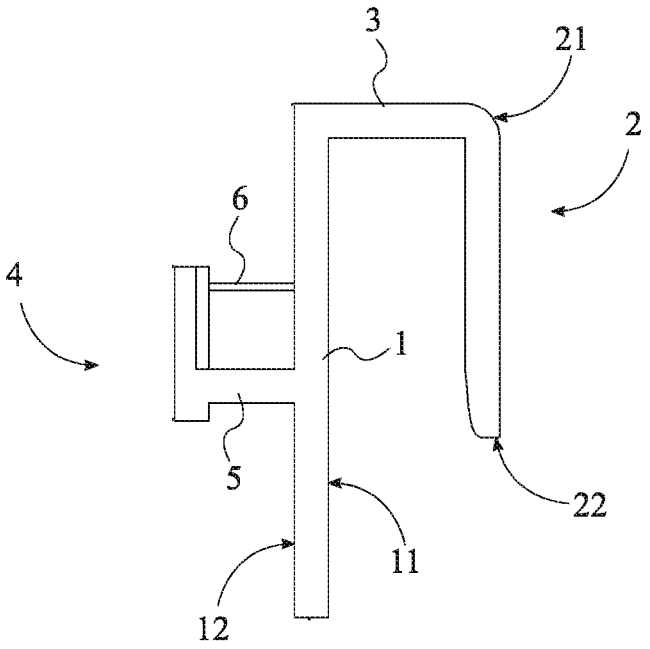
FIG. 5 is a left-side view of the present invention with the first brace extended.
Figure 6:
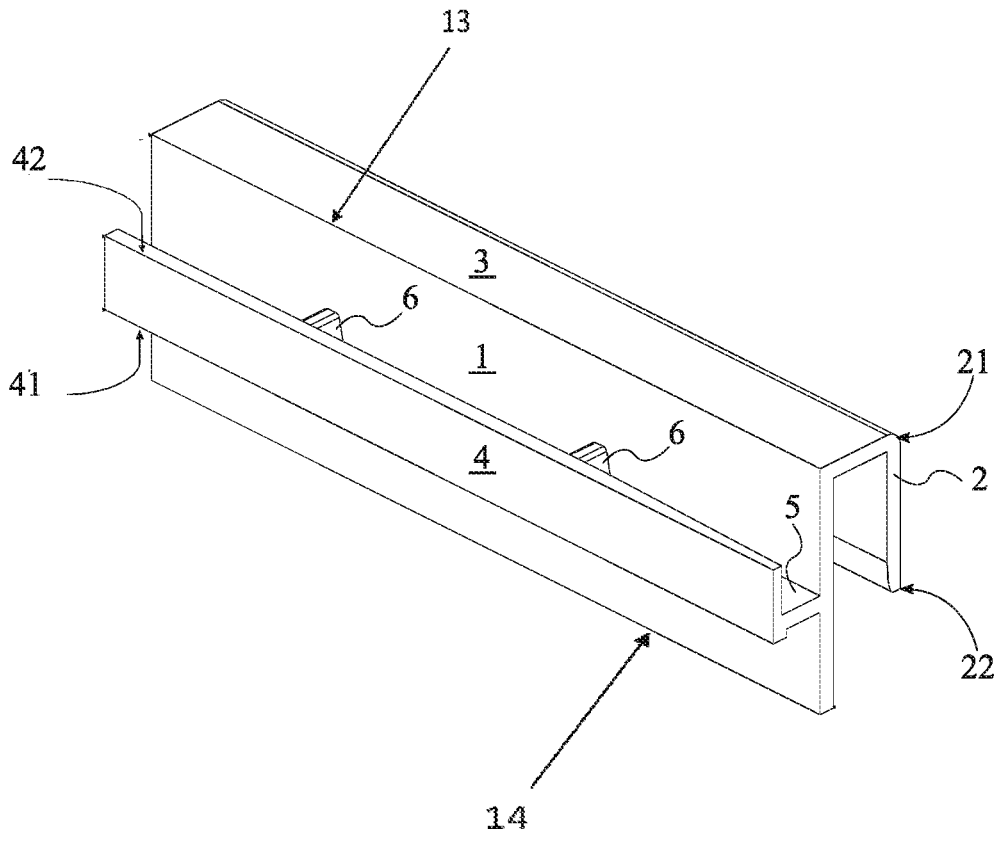
FIG. 6 is a perspective view of the present invention with the first brace extended.

All illustrations of the drawings are for the purpose of describing selected versions of the present invention and are not intended to limit the scope of the present invention.

The present invention, the fastener for mounting a frame onto a previously installed mirror, is an attachment mechanism that enables a user to retrofit a mirror with a desired frame. To accomplish this, the present invention makes use of a fastener that has opposing brackets which connect to the frame and the mirror respectively. The preferred method of use for the present invention is to attach a plurality of fasteners to the frame and then attach the frame to the mirror. By making use of a plurality of fasteners, the user is able to distribute the weight of a frame, and mount uniquely shaped frames onto uniquely shaped mirrors. Furthermore, the use of a plurality of fastener enables the user to attach a frame to a mirror without the use of adhesives, screws, or nails.

The present invention functions as a mounting device by combining the use of multiple braces that are positioned to form brackets which attach to the both the mirror and the frame. To accomplish this, the present invention comprises a support panel 1, a first brace 2, and a second brace 4. The support panel 1 is a rigid and flat slab of material that comprises a first face 11, a second face 12, a first lengthwise edge 13, and a second lengthwise edge 14. The first lengthwise edge 13 and the second lengthwise edge 14 are positioned opposite to each other across the support panel 1 so that the support panel 1 can be manufactured in a rectangular or trapezoidal shape. The positioning of the first lengthwise edge 13 and the second lengthwise edge 14 ensures that the first brace 2 will be able to attach the frame around the edge of the mirror. The second brace 4 enables the user to mount the frame in a position which facilitates creating a desired aesthetic.

The general configuration of the aforementioned components allows the present invention to efficiently and effectively make use of a rigid panel as the first brace 2. The first brace 2 is positioned offset and parallel from the first face 11. Consequently, the first brace 2 is used to fasten the present invention onto the mirror by letting the mirror slide between the first brace 2 and the support panel 1. To expound upon this, the first brace 2 is mounted onto the first face 11. As a result, the first brace 2 is configured to attach the present invention onto the edge of a mirror. The first brace 2 can be mounted onto the support panel 1 using components such as, but not limited to, clamps, spring-loaded leverage systems, rigid beams, and bars. Conversely, the second brace 4 is a rigid panel that is positioned offset and parallel from the second face 12. Thus positioned, the second brace 4 is used to fasten the present invention onto the frame by letting the frame slide in between the second brace 4 and the support panel 1. Additionally, the second brace 4 acts as a connection mechanism that is used to affix the frame to the present invention. The second brace 4 is mounted onto the second face 12; the side of the support panel 1 that is opposite to the first brace 2. Furthermore, the first brace 2 and the second brace 4 are positioned offset from each other across the support panel 1. Thus, the present invention is able to receive the mirror and the frame from opposing directions while still being able to use the support panel to evenly distribute the weight of the frame along the edge of the mirror to which the present invention is attached.

The present invention further comprises a first extension web 3 that is a rigid member. The first brace 2 is mounted onto the first face 11 by the first extension web 3. The first extension web is preferably a rigid beam that extends between the first brace 2 and the support panel 1. Preferably, this connection forms a U-shaped bracket that fits over the edge of the mirror. Consequently, the first extension web 3 maintains the first brace 2 in a position that enables the first brace 2 to brace the present invention against the mirror on which the present invention is mounted. In the preferred embodiment of the present invention, the first brace 2 and the first extension web 3 are both elongated strips. These elongated strips run the length of the support panel 1 and are used to distribute the weight of the frame along the support panel 1 and the mirror. Additionally, the first extension web 3 is adjacently and perpendicularly connected to the first face 11. Furthermore, the first brace 2 is mounted onto the first face 11 by the first extension web 3. Thus positioned, the first brace 2, the first extension web 3, and the support panel 1 form a U-shaped bracket that rests on the edge of the mirror on which the present invention is mounted. Finally, the first extension web 3 is positioned along the first lengthwise edge 13. Accordingly, the first extension web 3 and the first brace 2 prevent the frame from rotating about the edge of the mirror. In the preferred embodiment of the present invention, the first brace 2 comprises a free end 22 and a fixed end 21. The first brace 2 is mounted onto the first face 11 by the fixed end 21. Thus positioned, the first brace 2 forms a U-shaped bracket with the first extension web 3 and the support panel 1. This bracket shape enables the present invention to support the weight of the frame. A sagittal cross section of the first brace 2 tapers from the fixed end 21 to the free end 22 so that the first brace 2 can be wedged behind the mirror.

The present invention further comprises a second extension web 5 that is a rigid member, which extends from the support panel 1, opposite to the first extension web 3. Preferably, the second brace 4, the support panel 1, and the second extension web 5 form a U-shaped bracket that fits into the frame. The second brace 4 is mounted onto the second face 12 by the second extension web 5. Consequently, the second extension web 5 maintains the second brace 4 in a position that enables the second brace 4 to brace the present invention against the frame to which it is affixed. In the preferred embodiment of the present invention, the second brace 4 and the second extension web 5 are both elongated strips. These elongated strips run the length of the support panel 1 and are used to distribute the weight of the frame along the support panel 1. Additionally, the second extension web 5 is adjacently and perpendicularly connected to the second face 12. As a result, the second extension web 5 forms the connection member that is able to maintain the second brace 4 in a position that facilitates affixing a frame to the present invention. Furthermore, the second brace 4 is mounted onto the second face 12 by the second extension web 5. Thus positioned, the second brace 4, the second extension web 5, and the support panel 1 form a bracket that can be inserted into the frame to which the present invention is affixed. Finally, the second extension web 5 is positioned in between the first lengthwise edge 13 and the second lengthwise edge 14. Accordingly, the second extension web 5 and the second brace 4 are able to prevent the frame from moving out of an aesthetically pleasing position. This positioning prevents the frame from being easily dislodged.

The present invention further comprises a plurality of connection tabs 6. Each of the plurality of connection tabs 6 is a rigid support beam. Additionally, the plurality of connection tabs 6 is connected in between the second brace 4 and the second face 12 so that the plurality of connection tabs 6 is able to increase the rigidity of the second brace 4. The plurality of connection tabs 6 is distributed along the second brace 4. Consequently, the plurality of connection tabs 6 functions as a stabilization system which distributes the weight of the frame along the second brace 4 and the support panel 1. In the preferred embodiment of the present invention, a transversal cross section for each of the plurality of connection tabs 6 has a trapezoidal shape with a set of rounded vertices. As a result, each of the plurality of connection tabs 6 is designed to fit into the frame and prevent the frame from being laterally displaced, relative to the second brace 4.

In addition to supporting the weight of the frame, the second brace is configured to prevent the frame from becoming dislodged. To that end, the second brace 4 comprises a free edge 42 and a fixed edge 41. The second brace 4 is mounted onto the second face 12 by the fixed edge 41. Thus positioned, the second brace 4 forms a U-shaped bracket with the second extension web 5 and the support panel 1. This bracket shape enables the present invention to support the weight of the frame. The free edge 42 and the fixed edge 41 are positioned opposite to each other across the second brace 4. Accordingly, the free edge 42 functions as a support on which the frame rests while transferring the weight of the frame through the second brace 4 to the second extension web 5, which is connected to the fixed edge 41. The plurality of connection tabs 6 is positioned coincident with the fixed edge 41 so that the plurality of connection tabs 6 is able to further support the second extension web 5 and the second brace 4. The plurality of connection tabs 6 is positioned offset with the free edge 42. Consequently, the free edge 42 forms a lip that extends past the plurality of connection tabs 6 and further secures the frame. The second brace 4 preferably has a lip that extends from the fixed edge 41. This lip further restricts movement of the frame until the present invention is disengaged by the user.

Although the invention has been explained in relation to its preferred embodiment, it is to be understood that many other possible modifications and variations can be made without departing from the spirit and scope of the invention as hereinafter claimed.

What is claimed is:

1. A bracket for mounting a frame onto a previously installed mirror without requiring removal of the previously installed mirror, said bracket comprising:

a support panel having a first face and a second face;

a first bracket portion extending from said first face and configured to receive a portion of an outer edge of said previously installed mirror for removably securing said bracket to said previously installed mirror;

a second bracket portion extending from said second face and configured to receive and support said frame; and one or more connection tabs, each connected to both said support panel and said second brace, wherein the bracket is integrally formed.

2. The bracket of claim 1 wherein:

said first bracket portion comprises a first extension web extending horizontally outward from said first face and a first brace extending vertically downward from said first extension web; and said first face, an inner surface of said first extension web, and an inner surface of said first brace define a channel configured to receive the portion of the outer edge of said previously installed mirror.

3. The bracket of claim 2 wherein:

said second bracket portion comprises a second extension web extending horizontally outward from said second face and a second brace extending vertically upwards from said second extension web; and the second brace comprises a lower portion connected to said second extension web and an upper portion having a free edge.

4. The bracket of claim 3 wherein:

said support panel, said first brace, and said second brace are spaced apart and extend parallel with one another.

5. The bracket of claim 1 wherein:

each of said connection tabs comprises a trapezoidal cross section.

6. The bracket of claim 3 wherein:

said second bracket portion extends from a mid-portion of said second face; and said second brace extends below and above said second extension web such that a lower edge of said second brace is located below a lower edge of said second extension web.

7. The bracket of claim 3 wherein:

each of said number of connection tabs comprise a respective first end, second end, and a bottom edge, wherein the first end is connected to said second face, the second end is connected to the second brace, and the bottom edge is connected to said second extension web;

each of said number of connection tabs have an upper edge located below said free edge of said second brace; and each of said number of connection tabs are spaced apart along said second extension web.

8. A method for removably mounting a frame onto a previously installed mirror without removing the previously installed mirror or requiring permanent fasteners or adhesive, said method comprising the steps of:

providing the frame;

providing a number of brackets, each comprising a support panel having a first face and a second face, a first bracket portion extending from said first face and comprising a first extension web extending horizontally outward from said first face and a first brace extending vertically downward from said first extension web, and a second bracket portion extending from said second face and comprising a second extension web extending horizontally outward from said second face and a second brace extending vertically upwards from said second extension web;

removably securing the first bracket portion of each of said number of brackets in a spaced apart manner about at an outer edge of said previously installed mirror by letting said previously installed mirror slide between the first brace and the support panel; and removably securing the second bracket portion of each of said number of brackets into said frame by letting said frame slide between the second brace and the support panel such that a free edge of said second bracket portion contacts an interior surface of said frame;

wherein, upon completion of installation, said frame is installed to, and supported by, said previously installed mirror by way of said number of brackets in a removeable fashion.

9. The method of claim 8 wherein:

said first face, an interface surface of said first extension web, and an inner surface of said first brace of each of said number of brackets define a channel configured to receive a respective portion of the outer edge of said previously installed mirror.

10. The method of claim 9 wherein:

the second brace of each of said number of brackets comprises a lower portion connected to the second extension web; and said free edge of the second brace of each of said number of brackets is located along an upper edge of an upper portion of said second brace.

11. The method of claim 10 wherein:

each of said number of brackets further comprise a number of connection tabs, each extending from said support panel to said second brace of each of said number of brackets.

12. The method of claim 11 wherein:

each of said connection tabs comprises a trapezoidal cross section.

13. The method of claim 11 wherein:

said number of connection tabs fit into said frame; and said number of connection tabs are spaced apart along said second extension web and extend upward therefrom to define an upper edge located below the free edge of the second brace.

* * * * *